US011238802B2

(12) United States Patent
Shi et al.

(10) Patent No.: US 11,238,802 B2
(45) Date of Patent: Feb. 1, 2022

(54) PIXEL CIRCUIT AND DRIVING METHOD THEREFOR, DISPLAY PANEL, AND DISPLAY APPARATUS

(71) Applicants: YUNNAN INVENSIGHT OPTOELECTRONICS TECHNOLOGY CO., LTD., Yunnan (CN); BOE TECHNOLOGY GROUP CO., LTD., Beijing (CN)

(72) Inventors: Rongrong Shi, Beijing (CN); Shengji Yang, Beijing (CN); Kuanta Huang, Beijing (CN); Xiaochuan Chen, Beijing (CN); Pengcheng Lu, Beijing (CN)

(73) Assignees: Yunnan Invensight Optoelectrics Technology Co. Ltd., Kunming (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/042,575

(22) PCT Filed: Mar. 17, 2020

(86) PCT No.: PCT/CN2020/079591
§ 371 (c)(1),
(2) Date: Sep. 28, 2020

(87) PCT Pub. No.: WO2020/187195
PCT Pub. Date: Sep. 24, 2020

(65) Prior Publication Data

US 2021/0027714 A1 Jan. 28, 2021

(30) Foreign Application Priority Data

Mar. 19, 2019 (CN) ..... 201910209387.4

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/2003* (2013.01); *G09G 3/3266* (2013.01);
(Continued)

(58) Field of Classification Search
None
See application file for complete search history.

(56) References Cited

U.S. PATENT DOCUMENTS 6,501,448 B1 12/2002 Komiya et al.
2005/0122290 A1* 6/2005 Sun ..... G09G 3/3233 345/82
(Continued)

FOREIGN PATENT DOCUMENTS

CN 1435805 A 8/2003
CN 103778886 A 5/2014
(Continued)

OTHER PUBLICATIONS

First office action issued in Chinese Patent Application No. 201910209387.4 dated Mar. 6, 2020 with Search Report.

*Primary Examiner* — Nitin Patel
*Assistant Examiner* — Amen W Bogale
(74) *Attorney, Agent, or Firm* — Chiwin Law LLC

(57) ABSTRACT

A pixel circuit and a driving method thereof, a display panel, and a display device. The pixel circuit includes a driving circuit, a first switching circuit, a second switching circuit, and a first reset circuit. The driving circuit is configured to drive a light-emitting element to emit light, the first switching circuit is configured to be turned on in response to a first scanning signal to transmit a data signal to a control terminal
(Continued)

of the driving circuit, the second switching circuit is configured to be turned on in response to a light-emitting control signal to transmit a first power signal to a first terminal of the driving circuit, and the first reset circuit is configured to be turned on in response to a first reset control signal to transmit a reset signal to the first terminal of the driving circuit.

19 Claims, 5 Drawing Sheets

(51) Int. Cl.
*G09G 3/3275* (2016.01)
*G09G 3/20* (2006.01)

(52) U.S. Cl.
CPC ... *G09G 3/3275* (2013.01); *G09G 2300/0426* (2013.01); *G09G 2310/08* (2013.01); *G09G 2320/0214* (2013.01); *G09G 2320/0233* (2013.01)

(56) References Cited

U.S. PATENT DOCUMENTS

2010/0134427 A1* 6/2010 Tsai ..... G06F 3/0412 345/173
2014/0111557 A1 4/2014 Omata et al.
2014/0232705 A1 8/2014 Fujii et al.
2014/0333600 A1* 11/2014 Lee ..... G09G 3/325 345/212
2016/0225316 A1* 8/2016 Chaji ..... G09G 3/3233
2017/0236470 A1* 8/2017 Miki ..... G09G 3/3258 345/690
2018/0130410 A1* 5/2018 Gao ..... G09G 3/3225
2018/0151123 A1* 5/2018 Li ..... H01L 51/5203
2019/0189053 A1* 6/2019 Kim ..... G09G 3/3266
2019/0325824 A1 10/2019 Chen et al.
2020/0402457 A1* 12/2020 Ueno ..... G09G 3/3233
2021/0097936 A1* 4/2021 Ge ..... G09G 3/3258
2021/0104196 A1* 4/2021 Yuan ..... G09G 3/3291
2021/0201786 A1* 7/2021 Ma ..... G09G 3/3233
2021/0225281 A1* 7/2021 Han ..... G09G 3/3266

FOREIGN PATENT DOCUMENTS

CN 103890831 A 6/2014
CN 107038989 A 8/2017
CN 108255334 A 7/2018
CN 108510946 A 9/2018
CN 108806604 A 11/2018
CN 109448625 A 3/2019
CN 109712571 A 5/2019
JP 2017083800 A 5/2017
KR 20160092155 A 8/2016

* cited by examiner

900

PIXEL CIRCUIT AND DRIVING METHOD THEREFOR, DISPLAY PANEL, AND DISPLAY APPARATUS

This application is a U.S. National Phase Entry of International Application No. PCT/CN2020/079591 filed on Mar. 17, 2020, designating the United States of America and claiming priority to Chinese Patent Application No. 201910209387.4, filed on Mar. 19, 2019. The present application claims priority to and the benefit of the above-identified applications and the above-identified applications are incorporated by reference herein in their entirety.

TECHNICAL FIELD

Embodiments of the present disclosure relate to a pixel circuit and a driving method thereof, a display panel, and a display device.

BACKGROUND

With the development and progress of technology, people have higher and higher requirements for the display quality of display devices. In display devices, pixel circuits are usually used to drive pixel units to emit light. In the pixel circuit, a driving transistor is usually turned on by a data signal stored in a storage capacitor, and a light-emitting control transistor is controlled to be turned on by a light-emitting control signal, so that a light-emitting element is driven by a power signal to emit light.

SUMMARY

At least one embodiment of the present disclosure provides a pixel circuit, which includes: a driving circuit, a first switching circuit, a second switching circuit, and a first reset circuit. The driving circuit includes a first terminal, a second terminal, and a control terminal, and is configured to drive a light-emitting element connected to the second terminal to emit light. The first switching circuit is configured to be turned on in response to a first scanning signal to transmit a data signal to the control terminal of the driving circuit. The second switching circuit is connected to the first terminal of the driving circuit and is configured to be turned on in response to a light-emitting control signal to transmit a first power signal to the first terminal of the driving circuit. The first reset circuit is connected to the first terminal of the driving circuit and is configured to be turned on in response to a first reset control signal to transmit a reset signal to the first terminal of the driving circuit.

For example, the pixel circuit provided by at least one embodiment of the present disclosure further includes a third switching circuit. The third switching circuit includes a complementary metal oxide semiconductor circuit. The third switching circuit includes a first terminal, a second terminal, a first control terminal, and a second control terminal. The first terminal of the third switching circuit is connected to the first switching circuit, and the second terminal of the third switching circuit is connected to the control terminal of the driving circuit. The first control terminal is connected to a first scanning signal input terminal to receive the first scanning signal, and the third switching circuit is configured to be turned on in response to the first scanning signal to transmit the data signal from the first switching circuit to the control terminal of the driving circuit. The second control terminal is connected to a second scanning signal input terminal to receive a second scanning signal, and the third switching circuit is further configured to be turned on in response to the second scanning signal to transmit the data signal from the first switching circuit to the control terminal of the driving circuit.

For example, in the pixel circuit provided by at least one embodiment of the present disclosure, the first scanning signal and the second scanning signal are synchronized, and a trigger level of the first scanning signal is opposite to a trigger level of the second scanning signal.

For example, the pixel circuit provided by at least one embodiment of the present disclosure further includes: a second reset circuit, connected to a first terminal of the light-emitting element and configured to be turned on in response to a second reset control signal to transmit the reset signal to the first terminal of the light-emitting element.

For example, in the pixel circuit provided by at least one embodiment of the present disclosure, the first reset control signal and the second reset control signal are a same reset control signal.

For example, in the pixel circuit provided by at least one embodiment of the present disclosure, the driving circuit includes a driving transistor, a first electrode of the driving transistor serves as the first terminal of the driving circuit, a gate electrode of the driving transistor serves as the control terminal of the driving circuit, and a second electrode of the driving transistor serves as the second terminal of the driving circuit.

For example, in the pixel circuit provided by at least one embodiment of the present disclosure, the first switching circuit includes a first transistor, a first electrode of the first transistor is connected to a data signal input terminal to receive the data signal, a second electrode of the first transistor is connected to the first terminal of the third switching circuit, and a gate electrode of the first transistor is connected to a first scanning signal input terminal to receive the first scanning signal.

For example, in the pixel circuit provided by at least one embodiment of the present disclosure, the second switching circuit includes a second transistor, a first electrode of the second transistor is connected to a first power signal input terminal to receive the first power signal, a second electrode of the second transistor is connected to the first terminal of the driving circuit, and a gate electrode of the second transistor is connected to a light-emitting control signal input terminal to receive the light-emitting control signal.

For example, in the pixel circuit provided by at least one embodiment of the present disclosure, the first reset circuit includes a third transistor, a first electrode of the third transistor is connected to a reset signal input terminal to receive the reset signal, a second electrode of the third transistor is connected to the first terminal of the driving circuit, and a gate electrode of the third transistor is connected to a first reset control signal input terminal to receive the first reset control signal.

For example, in the pixel circuit provided by at least one embodiment of the present disclosure, the third switching circuit includes a fifth transistor and a sixth transistor. A first electrode of the fifth transistor is connected to the first switching circuit, a second electrode of the fifth transistor is connected to the control terminal of the driving circuit, and a gate electrode of the fifth transistor is connected to a first scanning signal input terminal to receive the first scanning signal. A first electrode of the sixth transistor is connected to the first switching circuit, a second electrode of the sixth transistor is connected to the control terminal of the driving circuit, and a gate electrode of the sixth transistor is connected to a second scanning signal input terminal to receive the second scanning signal.

For example, in the pixel circuit provided by at least one embodiment of the present disclosure, the fifth transistor is an N-type transistor and the sixth transistor is a P-type transistor, or the fifth transistor is a P-type transistor and the sixth transistor is an N-type transistor.

For example, in the pixel circuit provided by at least one embodiment of the present disclosure, the second reset circuit includes a fourth transistor, a first electrode of the fourth transistor is connected to a reset signal input terminal to receive the reset signal, a second electrode of the fourth transistor is connected to the first terminal of the light-emitting element, and a gate electrode of the fourth transistor is connected to a second reset control signal input terminal to receive the second reset control signal.

For example, the pixel circuit provided by at least one embodiment of the present disclosure further include a storage circuit, wherein the storage circuit is connected to the control terminal of the driving circuit, and is configured for storing the data signal.

For example, in the pixel circuit provided by at least one embodiment of the present disclosure, the storage circuit includes a storage capacitor, a first electrode of the storage capacitor is connected to the control terminal of the driving circuit, and a second electrode of the storage capacitor is connected to a second power signal input terminal to receive a second power signal.

At least one embodiment of the present disclosure further provides a pixel circuit, including a first transistor, a second transistor, a third transistor, a fourth transistor, a fifth transistor, a sixth transistor, a driving transistor, and a storage capacitor. A first electrode of the first transistor is connected to a data signal input terminal to receive a data signal, a second electrode of the first transistor is connected to a first electrode of the fifth transistor, and a gate electrode of the first transistor is connected to a first scanning signal input terminal to receive a first scanning signal. A first electrode of the second transistor is connected to a first power signal input terminal to receive a first power signal, a second electrode of the second transistor is connected to a first electrode of the driving transistor, and a gate electrode of the second transistor is connected to a light-emitting control signal input terminal to receive a light-emitting control signal. A first electrode of the third transistor is connected to a reset signal input terminal to receive a reset signal, a second electrode of the third transistor is connected to the first electrode of the driving transistor, and a gate electrode of the third transistor is connected to a first reset control signal input terminal to receive a first reset control signal. A first electrode of the fourth transistor is connected to the reset signal input terminal to receive the reset signal, a second electrode of the fourth transistor is connected to a second electrode of the driving transistor, and a gate electrode of the fourth transistor is connected to a second reset control signal input terminal to receive a second reset control signal. A second electrode of the fifth transistor is connected to a gate electrode of the driving transistor, and a gate electrode of the fifth transistor is connected to the first scanning signal input terminal to receive the first scanning signal. A first electrode of the sixth transistor is connected to the second electrode of the first transistor, a second electrode of the sixth transistor is connected to the gate electrode of the driving transistor, and a gate electrode of the sixth transistor is connected to a second scanning signal input terminal to receive a second scanning signal. A first electrode of the storage capacitor is connected to the gate electrode of the driving transistor, and a second electrode of the storage capacitor is connected to a second power signal input terminal to receive a second power signal.

At least one embodiment of the present disclosure further provides a driving method of a pixel circuit, used for driving the pixel circuit as described in the above-mentioned embodiments, wherein the driving method includes: in a first phase, turning off the first switching circuit by using the first scanning signal, turning off the second switching circuit by using the light-emitting control signal, turning on the first reset circuit by using the first reset control signal, and resetting the first terminal of the driving circuit through the reset signal; in a second phase, turning on the first switching circuit by using the first scanning signal, turning off the second switching circuit by using the light-emitting control signal, turning on the first reset circuit by using the first reset control signal, and writing the data signal to the control terminal of the driving circuit; and in a third phase, turning off the first switching circuit by using the first scanning signal, turning on the second switching circuit by using the light-emitting control signal, and turning off the first reset circuit by using the first reset control signal, so as to allow the driving circuit to drive the light-emitting element to emit light.

For example, in the driving method of the pixel circuit provided by at least one embodiment of the present disclosure, in a case where the pixel circuit further includes a third switching circuit, the driving method further includes: in the first phase, turning off the third switching circuit by using the first scanning signal and the second scanning signal; in the second phase, turning on the third switching circuit by using the first scanning signal and the second scanning signal; and in the third phase, turning off the third switching circuit by using the first scanning signal and the second scanning signal.

At least one embodiment of the present disclosure further provides a display panel, including the pixel circuit as described in the above-mentioned embodiments.

At least one embodiment of the present disclosure further provides a display device, including the pixel circuit as described in the above-mentioned embodiments.

For example, the display device provided by at least one embodiment of the present disclosure further includes an array substrate, the pixel circuit is on the array substrate, the array substrate includes a pixel region and a non-pixel region, and the first reset circuit is in the non-pixel region.

For example, in the display device provided by at least one embodiment of the present disclosure, in a case where the pixel circuit further includes a second reset circuit, the second reset circuit is in the non-pixel region.

BRIEF DESCRIPTION OF THE DRAWINGS

In order to clearly illustrate the technical solutions of the embodiments of the present disclosure, the drawings of the embodiments will be briefly described in the following. It is obvious that the described drawings are only related to some embodiments of the present disclosure and thus are not limitative to the present disclosure.

DETAILED DESCRIPTION

Figure 1:
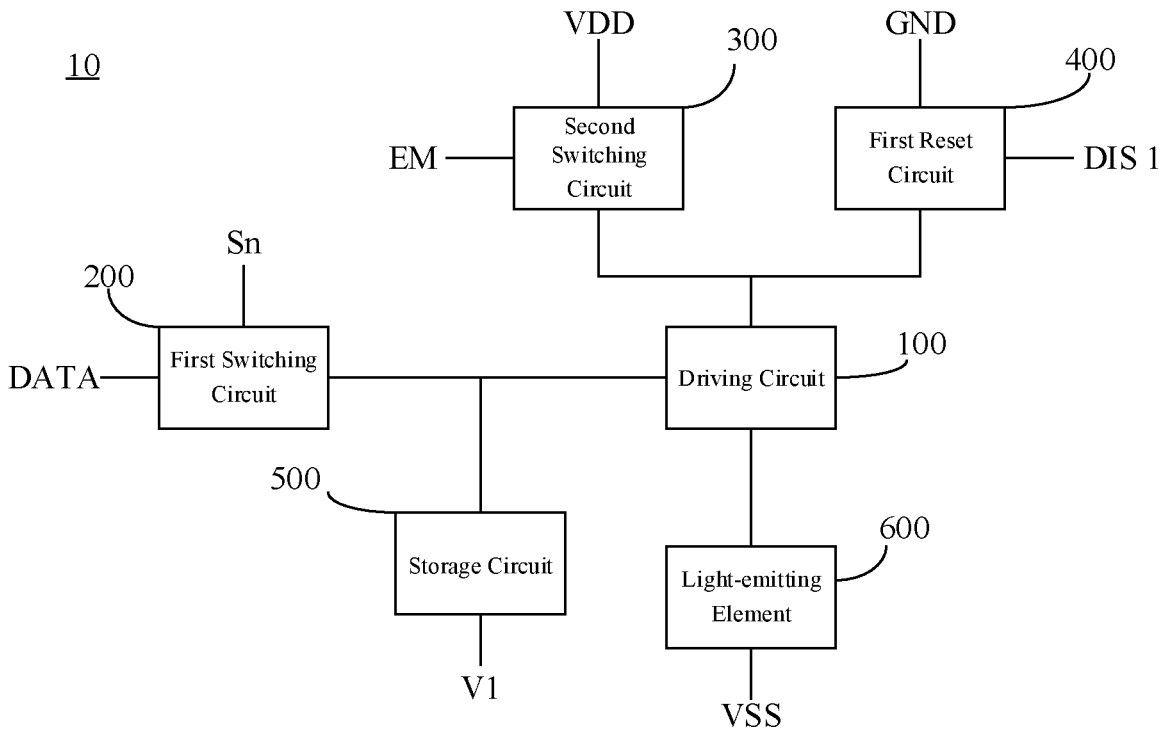
FIG. 1 is a schematic diagram of a first pixel circuit provided by at least one embodiment of the present disclosure.

Example embodiments will now be described more fully with reference to the accompanying drawings. However, the exemplary embodiments can be implemented in a variety of forms and should not be construed to be limited to the embodiments described herein; on the contrary, these embodiments are provided to make the present disclosure comprehensive and complete, and the concept of the example embodiments will be fully conveyed to those skilled in the art. In the drawings, the same reference numeral represents the same or similar part, and repeated description will be omitted.

Further, the described features, structures or characteristics may be combined in one or more embodiments in any suitable manner. In the following description, many specific details are provided to provide a full understanding of the embodiments of the present disclosure. However, those skilled in the art will be aware that the technical solutions of the present disclosure may be practiced without one or more of the specific details described, or other methods, components, materials, devices, steps, etc. may be employed. In other cases, well-known structures, methods, devices, implementations, materials, or operations are not shown or described in detail to avoid obscuring aspects of the present disclosure.

The blocks shown in the accompanying drawings is only functional entities and do not necessarily correspond to physically independent entities. That is, these functional entities can be implemented in software form, or implemented in one or more software hardened modules, or in different networks and/or processor devices and/or microcontroller devices.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In a conventional pixel circuit, because of the influence of the internal parasitic capacitance of the thin film transistor (TFT), there is a voltage difference between the gate electrode and drain electrode of the driving transistor. Usually, the drain electrode of the driving transistor is in the floating state during the reset phase and the data writing phase, so that the level of the gate electrode of the driving transistor is not fixed. Therefore, the level of the gate electrode of the driving transistor may fluctuate due to the parasitic capacitance during the light-emitting phase, thereby causing problems such as uneven display of the display device. At least one embodiment of the present disclosure provides a pixel circuit, and the pixel circuit includes a driving circuit, a first switching circuit, a second switching circuit, and a first reset circuit. The driving circuit includes a first terminal, a second terminal, and a control terminal, and is configured to drive a light-emitting element connected to the second terminal of the driving circuit to emit light. The first switching circuit is configured to be turned on in response to a first scanning signal to transmit a data signal to the control terminal of the driving circuit. The second switching circuit is connected to the first terminal of the driving circuit, and is configured to be turned on in response to a light-emitting control signal to transmit a first power signal to the first terminal of the driving circuit. The first reset circuit is connected to the first terminal of the driving circuit, and is configured to be turned on in response to a first reset control signal to transmit a reset signal to the first terminal of the driving circuit.

At least one embodiment of the present disclosure further provides a driving method of a pixel circuit, used for driving the pixel circuit according to the above embodiments. The method includes: in a first phase, turning off the first switching circuit by using the first scanning signal, turning off the second switching circuit by using the light-emitting control signal, turning on the first reset circuit by using the first reset control signal, and resetting the first terminal of the driving circuit through the reset signal; in a second phase, turning on the first switching circuit by using the first scanning signal, turning off the second switching circuit by using the light-emitting control signal, turning on the first reset circuit by using the first reset control signal, and writing the data signal to the control terminal of the driving circuit; and in a third phase, turning off the first switching circuit by using the first scanning signal, turning on the second switching circuit by using the light-emitting control signal, and turning off the first reset circuit by using the first reset control signal, so as to allow the driving circuit to drive the light-emitting element to emit light.

The pixel circuit provided by at least one embodiment of the present disclosure may reduce the influence of the parasitic capacitance on the level of the gate electrode of the driving transistor during the light-emitting phase, thereby overcoming the problem of uneven display of the display device to a certain extent.

The pixel circuit provided by at least one embodiment of the present disclosure may also reduce the leakage of the storage circuit of the pixel circuit at the control terminal of the first switching circuit, and solve the problem of crosstalk of the display device due to the level loss of the storage circuit caused by the leakage, thereby improving the display quality; and may also reduce loss of the data voltage, increase the range of the data voltage, and facilitate the implementation of fine gray level display.

Hereinafter, embodiments of the present disclosure are described in detail with reference to the accompany drawings. It should be noted that the same reference numerals in different drawings are used to refer to the same described elements.

At least one embodiment of the present disclosure provides a pixel circuit 10. As illustrated in FIG. 1, the pixel circuit 10 includes a driving circuit 100, a first switching circuit 200, a second switching circuit 300, a first reset circuit 400, and a storage circuit 500. The driving circuit 100 includes a first terminal, a second terminal, and a control terminal, and is configured to drive a light-emitting element 600 to emit light. The first switching circuit 200 is configured to be turned on in response to a first scanning signal Sn to transmit a data signal DATA to the control terminal of the driving circuit 100. The second switching circuit 300 is connected to the first terminal of the driving circuit 100 and is configured to be turned on in response to a light-emitting control signal EM to transmit a first power signal VDD to the first terminal of the driving circuit 100. The first reset circuit 400 is connected to the first terminal of the driving circuit 100 and is configured to be turned on in response to a first reset control signal DIS1 to transmit a reset signal GND to the first terminal of the driving circuit 100. The storage circuit 500 is connected to the control terminal of the driving circuit 100 and is configured to store the data signal DATA.

In at least one embodiment of the present disclosure, for example, a first terminal of the first switching circuit 200 is connected to a data signal input terminal to receive the data signal DATA, a second terminal of the first switching circuit 200 is connected to the control terminal of the driving circuit 100, and a control terminal of the first switching circuit 200 is connected to a first scanning signal input terminal to receive the first scanning signal Sn.

For example, a first terminal of the second switching circuit 300 is connected to a first power signal input terminal to receive the first power signal VDD, a second terminal of the second switching circuit 300 is connected to the first terminal of the driving circuit 100, and a control terminal of the second switching circuit 300 is connected to a light-emitting control signal input terminal to receive the light-emitting control signal EM.

For example, a first terminal of the first reset circuit 400 is connected to a reset signal input terminal to receive the reset signal GND, a second terminal of the first reset circuit 400 is connected to the first terminal of the driving circuit 100, and a control terminal of the first reset circuit 400 is connected to a first reset control signal input terminal to receive the first reset control signal DIS1.

For example, a first terminal of the storage circuit 500 is connected to the control terminal of the driving circuit 100, and a second terminal of the storage circuit 500 is connected to a second power signal input terminal V1. For example, the second power signal input terminal V1 may be configured to keep inputting a low-level DC signal, such as being grounded. The embodiments of the present disclosure are not limited in this aspect.

In the pixel circuit provided by at least one embodiment of the present disclosure, the first reset circuit 400 is turned on in response to the first reset control signal DIS1 to initialize the first terminal of the driving circuit 100 (for example, the first electrode of the driving transistor DT), so as to prevent the first terminal of the driving circuit 100 from be in the floating state during the reset phase and the data writing phase, and meanwhile, to prevent the level of the control terminal of the driving circuit 100 (for example, the gate electrode of the driving transistor DT) from fluctuating during the light-emitting phase due to the influence of parasitic capacitance, thereby alleviating the problem of uneven display of the display device and improving the display quality.

Figure 2:
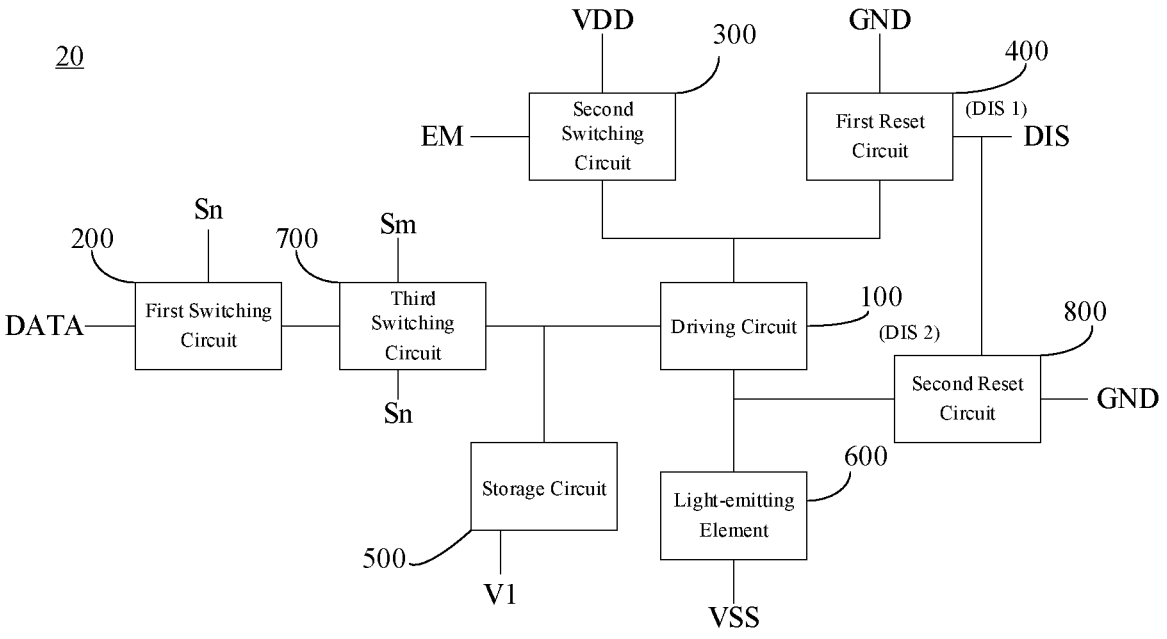
FIG. 2 is a schematic diagram of a second pixel circuit provided by at least one embodiment of the present disclosure.

For example, at least one embodiment of the present disclosure further provides a pixel circuit 20. As illustrated in FIG. 2, compared to the pixel circuit 10 illustrated in FIG. 1, the pixel circuit 20 further includes a third switching circuit 700 and a second reset circuit 800. For example, the third switching circuit 700 may include a complementary metal oxide semiconductor (CMOS) circuit. For example, the third switching circuit 700 includes a first terminal, a second terminal, a first control terminal, and a second control terminal. The first terminal of the third switching circuit 700 is connected to the second terminal of the first switching circuit 200, and the second terminal of the third switching circuit 700 is connected to the control terminal of the driving circuit 100. The first control terminal of the third switching circuit 700 is connected to the first scanning signal input terminal to receive the first scanning signal Sn, and the third switching circuit 700 is configured to be turned on in response to the first scanning signal Sn to transmit the data signal DATA from the first switching circuit 200 to the control terminal of the driving circuit 100. The second control terminal of the third switching circuit 700 is connected to the second scanning signal input terminal to receive the second scanning signal Sm. The third switching circuit 700 is also configured to be turned on in response to the second scanning signal Sm to transmit the data signal DATA from the first switching circuit 200 to the control terminal of the driving circuit 100.

The third switching circuit 700 is controlled by the first scanning signal Sn and the second scanning signal Sm, which may reduce the leakage of the storage circuit 500 of the pixel circuit at the control terminal of the first switching circuit 200, so that the problem of crosstalk of the display device due to the level loss of the storage circuit 500 caused by the leakage is solved, thereby improving the display quality. Further, the loss of the data voltage is reduced, and the range of the data voltage is increased, so as to facilitate the implementation of fine gray level display.

As illustrated in FIG. 2, for example, in at least one embodiment of the present disclosure, the pixel circuit 20 may include a second reset circuit 800 in addition to the third switching circuit 700, and the second reset circuit 800 is used to be turned on in response to the second reset control signal DIS2 to transmit the reset signal GND to the first terminal of the light-emitting element 600.

For example, the first terminal of the second reset circuit 800 is connected to the reset signal input terminal to receive the reset signal GND, the second terminal of the second reset circuit 800 is connected to the first terminal of the light-emitting element 600, and the control terminal of the second reset circuit 800 is connected to the second reset control signal input terminal to receive the second reset control signal DIS2. For example, as illustrated in FIG. 2, in some examples, the first reset control signal DIS1 received by the control terminal of the first reset circuit 400 and the second reset control signal DIS2 received by the control terminal of the second reset circuit 800 may be the same reset control signal DIS, that is, the control terminal of the first reset circuit 400 and the control terminal of the second reset circuit 800 are connected to the same reset control signal input terminal. For example, in some examples, the first reset control signal DIS1 received by the control terminal of the first reset circuit 400 and the second reset control signal DIS2 received by the control terminal of the second reset circuit 800 may also be independent reset control signals, respectively. The embodiments of the present disclosure are not limited in the aspect and the arrangement may depend on actual requirements.

The first terminal of the light-emitting element 600 is initialized through the second reset circuit 800, so as to avoid the afterimage or smear phenomenon during the display of the next frame after one frame is displayed. For example, in some examples, the first reset circuit 400 and the second reset circuit 800 share the same reset control signal DIS. This arrangement may reduce the area of the pixel wiring layer, which may facilitate high PPI design.

It should be noted that, except the third switching circuit 700 and the second reset circuit 800, other circuit structures of the pixel circuit 20 are basically the same as those of the pixel circuit described in FIG. 1. Detailed descriptions of the repeated structures are not omitted herein, and may refer to the relevant contents of FIG. 1.

It should also be noted that in the embodiments and drawings of the present disclosure, VSS may represent both the third power signal and the third power signal input terminal; similarly, Sn may represent both the first scanning signal input terminal and the first scanning signal; Sm may represent both the second scanning signal input terminal and the second scanning signal; DATA may represent both the data signal input terminal and the data signal; DIS may represent both the reset control signal input terminal and the reset control signal; DIS1 may represent both the first reset control signal input terminal and the first reset control signal; DIS2 may represent both the second reset control signal input terminal and the second reset control signal; GND may represent both the reset signal input terminal and the reset signal; EM may represent both the light-emitting control signal input terminal and the light-emitting control signal; VDD may represent both the first power signal input terminal and the first power signal; V1 may represent both the second power signal and the second power signal input terminal; and so on. Details are not described herein again.

Figure 3:
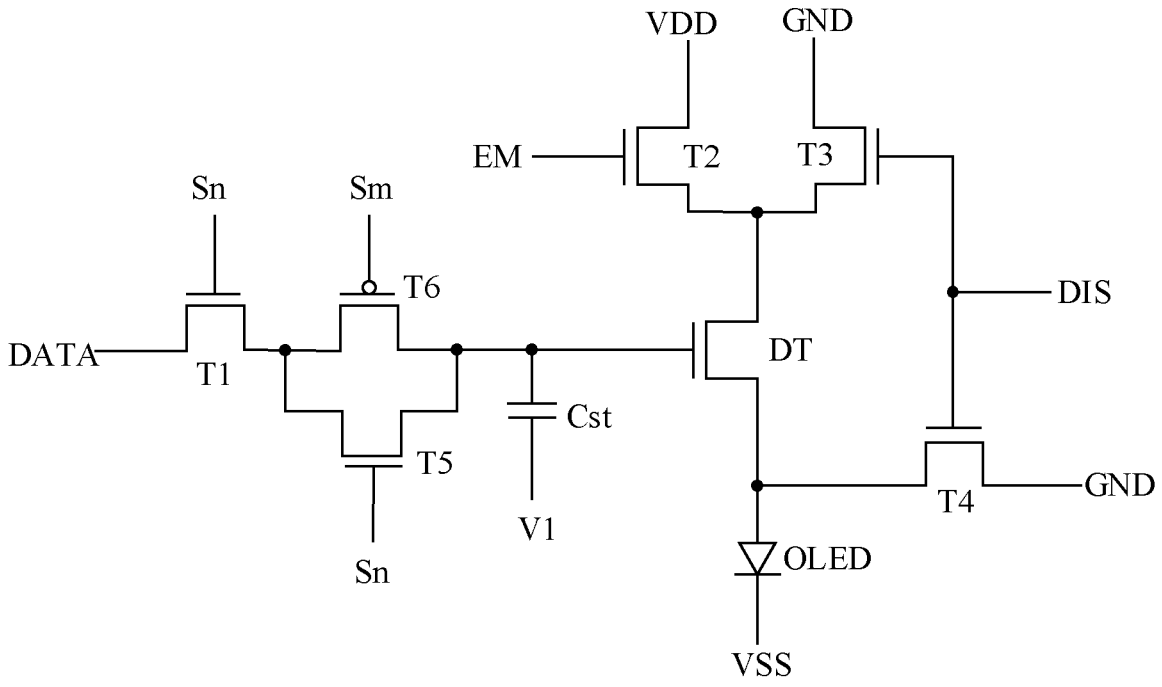
FIG. 3 is a schematic diagram of a third pixel circuit provided by at least one embodiment of the present disclosure.

The various circuits included in the pixel circuit provided by the embodiments of the present disclosure are described in detail below, and FIG. 3 is a particular circuit structure diagram corresponding to the pixel circuit in FIG. 2. As illustrated in FIG. 3, the description of FIG. 3 is based on the premise that the sixth transistor T6 is a P-type transistor, and the other transistors T1-T5 are all N-type transistors. It is assumed that the first power signal VDD is a high-level signal, and the third power signal VSS is a low-level signal; and the light-emitting element 600 is an organic light-emitting diode OLED, the first terminal of the light-emitting element 600 is the anode of the OLED, and the second terminal of the light-emitting element 600 is the cathode of the OLED.

As illustrated in FIG. 3, for example, in at least one embodiment of the present disclosure, the driving circuit 100 includes a driving transistor DT. A first electrode of the driving transistor DT is connected to the second terminal of the second switching circuit 300 and is connected to the second terminal of the first reset circuit 400, a gate electrode of the driving transistor DT is connected to the second terminal of the third switching circuit 700, and a second electrode of the driving transistor DT is connected to the first terminal of the light-emitting element 600.

For example, the first switching circuit 200 includes a first transistor T1, a first electrode of the first transistor T1 is connected to the data signal input terminal to receive the data signal DATA, a second electrode of the first transistor T1 is connected to the first terminal of the third switching circuit (for example, a first electrode of the fifth transistor T5 and a first electrode of the sixth transistor T6), and a gate electrode of the first transistor T1 is connected to the first scanning signal input terminal to receive the first scanning signal Sn.

For example, the second switching circuit 300 includes a second transistor T2, a first electrode of the second transistor T2 is connected to the first power signal input terminal to receive the first power signal VDD, a second electrode of the second transistor T2 is connected to the first terminal of the driving circuit 100, for example, the first electrode of the driving transistor DT, and a gate electrode of the second transistor T2 is connected to the light-emitting control signal input terminal to receive the light-emitting control signal EM.

For example, the first reset circuit 400 includes a third transistor T3, a first electrode of the third transistor T3 is connected to the reset signal input terminal to receive the reset signal GND, a second electrode of the third transistor T3 is connected to the first terminal of the driving circuit 100, for example, the first electrode of the driving transistor DT, and a gate electrode of the third transistor T3 is connected to the first reset control signal input terminal to receive the first reset control signal DIS1 (i.e., the reset control signal DIS).

For example, the second reset circuit 800 includes a fourth transistor T4, a first electrode of the fourth transistor T4 is connected to the reset signal input terminal to receive the reset signal GND, a second electrode of the fourth transistor T4 is connected to the first terminal of the light-emitting element 600, and a gate electrode of the fourth transistor T4 is connected to the second reset control signal input terminal to receive the second reset control signal DIS2 (i.e., the reset control signal DIS).

For example, as illustrated in FIG. 3, the gate electrode of the fourth transistor T4 and the gate electrode of the third transistor T3 may share the same reset control signal input terminal, that is, the first reset control signal DIS1 and the second reset control signal DIS2 may be the same reset control signal DIS.

For example, the third switching circuit 700 includes a complementary metal oxide semiconductor (CMOS) circuit, the first terminal of the CMOS circuit is connected to the second terminal of the first switching circuit 200, the second terminal of the CMOS circuit is connected to the control terminal of the driving circuit 100, the first control terminal of the CMOS circuit is connected to the first scanning signal input terminal to receive the first scanning signal Sn, and the second control terminal of the CMOS circuit is connected to the second scanning signal input terminal to receive the second scanning signal Sm. For example, in some examples, the third switching circuit 700 may include a fifth transistor T5 and a sixth transistor T6. For example, in the case where the transistors T1-T4 are all N-type transistors, the fifth transistor T5 may be an N-type transistor, and the sixth transistor T6 may be a P-type transistor. A first electrode of the fifth transistor T5 is connected to a first electrode of the sixth transistor T6 and connected to the second terminal of the first switching circuit 200, for example, the second electrode of the first transistor T1. A second electrode of the fifth transistor T5 is connected to a second electrode of the sixth transistor T6 and connected to the control terminal of the driving circuit 100, for example, the gate electrode of the driving transistor DT. A gate electrode of the fifth transistor T5 is connected to the first scanning signal input terminal to receive the first scanning signal Sn, and a gate electrode of the sixth transistor T6 is connected to the second scanning signal input terminal to receive the second scanning signal Sm. For example, in some examples, the first scanning signal Sn and the second scanning signal Sm are synchronized, and the trigger level of the first scanning signal Sn and the trigger level of the second scanning signal Sm are opposite. For example, in some examples, the trigger level of the first scanning signal Sn is a high level, and the trigger level of the second scanning signal Sm is a low level, which is not specifically limited in the present disclosure.

For example, in at least one embodiment of the present disclosure, the light-emitting element 600 may be an organic light-emitting diode (OLED), a first terminal of the OLED is connected to the second terminal of the driving circuit 100, such as the second electrode of the driving transistor DT, and a second terminal of the OLED is connected to the third power signal input terminal to receive the third power signal VSS. For example, the third power signal VSS may be a low-level signal provided by a stable power supply, which is not specifically limited in the embodiments of the present disclosure.

For example, in at least one embodiment of the present disclosure, the storage circuit 500 may be a storage capacitor Cst. A first electrode of the storage capacitor Cst is connected to the control terminal of the driving circuit 100, such as the gate electrode of the driving transistor DT, and a second electrode of the storage capacitor Cst is connected to the second power signal input terminal V1. For example, the second power signal input terminal V1 may be configured to provide a low-level signal, which is not specifically limited in the embodiments of the present disclosure. For example, the second power signal provided by the second power signal input terminal V1 and the third power signal VSS may be the same signal, or may be different signals, which is not limited in the embodiments of the present disclosure.

It should be noted that, in the embodiments of the present disclosure, the driving circuit 100, the first switching circuit 200, the second switching circuit 300, the first reset circuit 400, the second reset circuit 800, the third level circuit, and so on all have control terminals, first terminals, and second terminals. Each of the first to sixth transistors T1-T6 has a gate electrode, a first electrode, and a second electrode. Specifically, the control terminal of each circuit may be the gate electrode of the transistor included therein, the first terminal may be the source electrode of the corresponding transistor, and the second terminal may be the drain electrode of the corresponding transistor; or, the first terminal may be the drain electrode of the corresponding transistor, and the second terminal may be the source electrode of the corresponding transistor. In addition, each transistor may also be an enhancement transistor or a depletion transistor, which is not specifically limited in the embodiments of the present disclosure.

Figure 4:
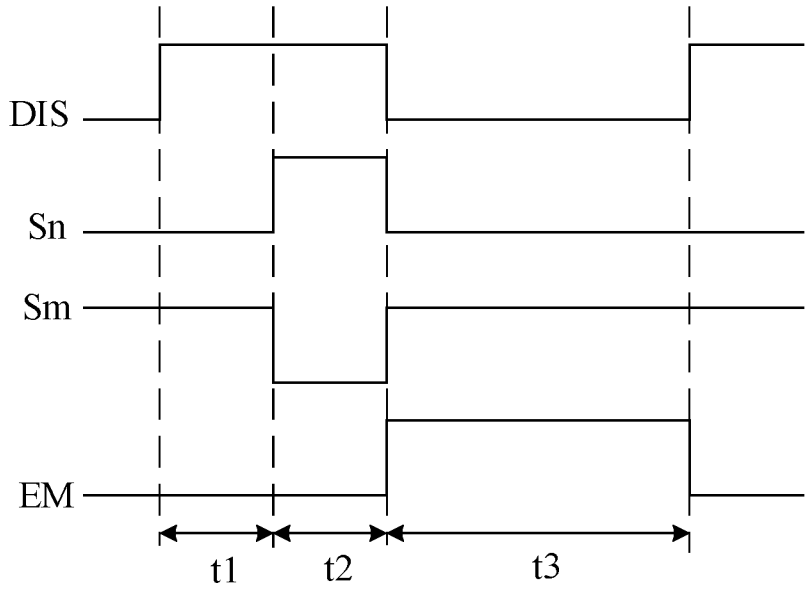
FIG. 4 is a driving timing diagram of a pixel circuit provided by at least one embodiment of the present disclosure.

The operating process of the pixel circuit in FIG. 3 is described in detail below in connection with the working timing diagram of the pixel circuit illustrated in FIG. 4. The driving timing diagram illustrates the level states of the first scanning signal Sn, the second scanning signal Sm, the reset control signal DIS, and the light-emitting control signal EM. In this embodiment, the first to fifth transistors T1-T5 are all N-type transistors, and the sixth transistor T6 is a P-type transistor as an example.

The first period t1 (a reset phase): the first scanning signal Sn is at a low level, the second scanning signal Sm is at a high level, the reset control signal DIS is at a high level, and the light-emitting control signal EM is at a low level. The first scanning signal Sn turns off the first transistor T1 and the fifth transistor T5, the second scanning signal Sm turns off the sixth transistor, the reset control signal DIS turns on the third transistor T3 and the fourth transistor T4, the light-emitting control signal EM turns off the second transistor T2, and the first electrode of the driving transistor DT and the first terminal of the light-emitting element 600 are reset through the reset signal GND.

The second period t2 (a writing phase): the first scanning signal Sn is at a high level, the second scanning signal Sm is at a low level, the reset control signal DIS is at a high level, and the light-emitting control signal EM is at a low level. The first scanning signal Sn turns on the first transistor T1 and the fifth transistor T5, the second scanning signal Sm turns on the sixth transistor T6, the reset control signal DIS turns on the third transistor T3 and the fourth transistor T4, the light-emitting control signal EM turns off the second transistor T2, and the data signal DATA is written to the storage circuit 500 (for example, the storage capacitor Cst).

The third period t3 (a light-emitting phase): the first scanning signal Sn is at a low level, the second scanning signal Sm is at a high level, the reset control signal DIS is at a low level, and the light-emitting control signal EM is at a high level. The first scanning signal Sn turns off the first transistor T1 and the fifth transistor T5, the second scanning signal Sm turns off the sixth transistor T6, the reset control signal DIS turns off the third transistor T3 and the fourth transistor T4, and the light-emitting control signal EM turns on the second transistor T2 to enable the first power signal VDD to drive the light-emitting element 600 to emit light.

In a conventional pixel circuit, a metal oxide semiconductor (MOS) dual-gate structure (the MOS dual-gate structure may be structurally regarded as a series connection of two single MOS transistors, a second gate electrode being provided in addition to the first gate electrode so as to allow the feedback capacitance between the drain electrode and the first gate electrode to become very small) may reduce the leakage current of the storage capacitor Cst. But the series connection of two single MOS transistors may cause voltage loss of the input data signal DATA, and may reduce the data range, which is not conducive to the implementation of fine gray level display. The embodiments of the present disclosure may reduce the leakage current and reduce voltage loss of the data signal DATA through the MOS dual-gate structure and the CMOS structure (the CMOS structure may be structurally regarded as a parallel connection of two single MOS transistors, and the types of the two single MOS transistors are different, for example, one of the single MOS transistors is of an N type, the other of the single MOS transistors is of a P-type, and vice versa).

Figure 5:
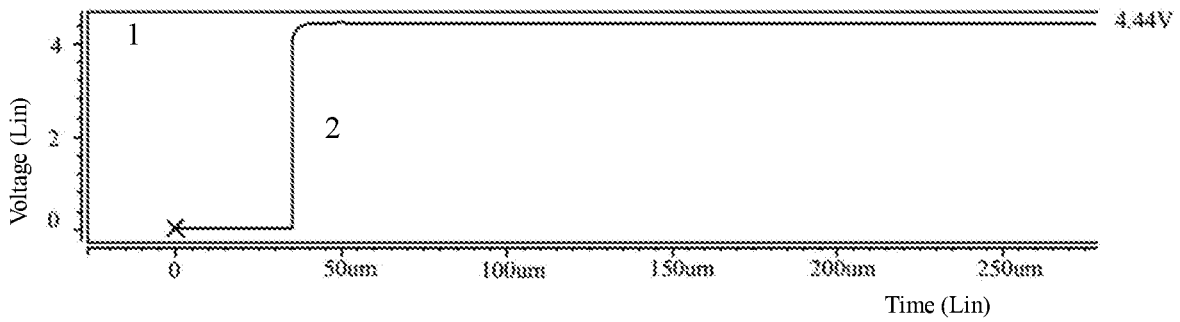
FIG. 5 is a schematic diagram of input voltage loss simulation of a single MOS structure according to at least one embodiment of the present disclosure.
Figure 6:
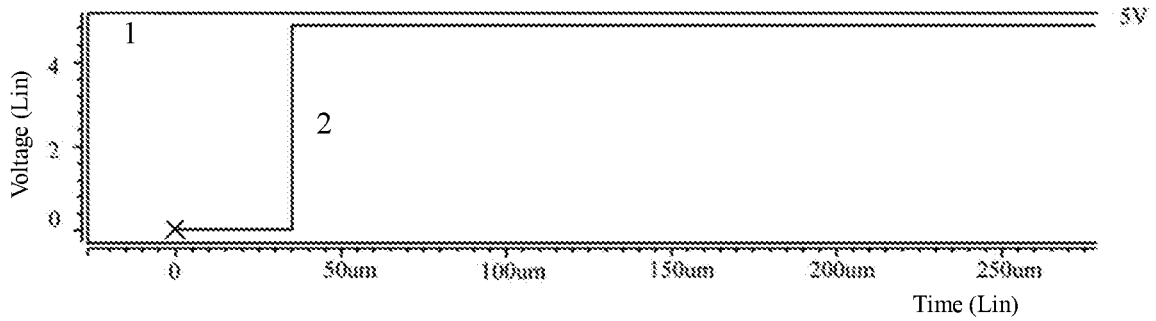
FIG. 6 is a schematic diagram of input voltage loss simulation of a CMOS structure according to at least one embodiment of the present disclosure.

FIG. 5 is a schematic diagram of input voltage loss of one MOS transistor simulated by software (such as Hspice software). As illustrated in FIG. 5, in the case of a single MOS transistor structure, where the input signal is 5 V (as illustrated in the curve 1 in FIG. 5), the output voltage is about 4.44 V (as illustrated in the curve 2 in FIG. 5), and the voltage loss is 0.56 V. FIG. 6 is a schematic diagram of input voltage loss using the CMOS circuit structure design. As illustrated in FIG. 6, where the input voltage is 5 V (as illustrated in the curve 1 in FIG. 6), the output voltage is about 5 V (as illustrated in the curve 2 in FIG. 5), and there is no voltage loss, so that the CMOS structure circuit effectively improves the data voltage range of the input signal.

Figure 7:
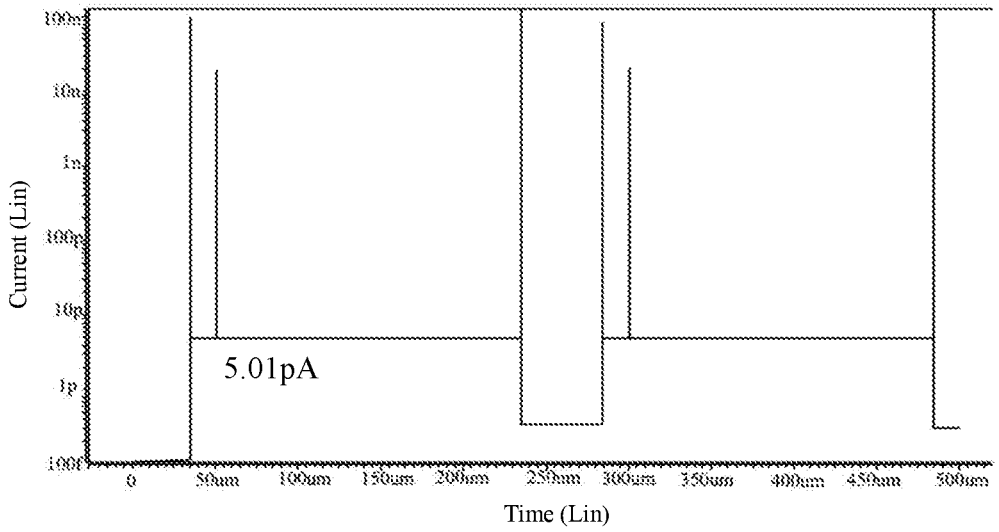
FIG. 7 is a schematic diagram of leakage current simulation of a storage capacitor in a conventional pixel circuit.
Figure 8:
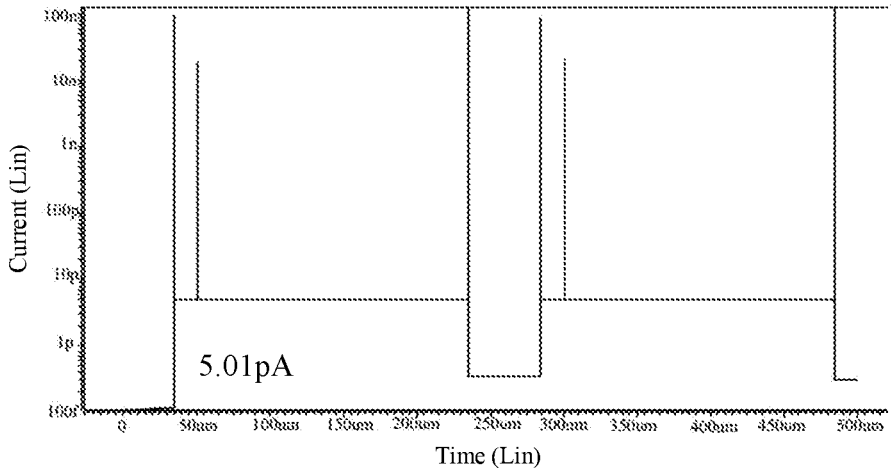
FIG. 8 is a schematic diagram of leakage current simulation of a storage capacitor in a pixel circuit according to at least one embodiment of the present disclosure.

FIG. 7 is a schematic diagram of simulation of the leakage current of the gate electrode of the MOS transistor using software (such as Hspice software). As illustrated in FIG. 7, where the dual-gate electrode is off (that is, where both MOS transistors are turned off), the leakage current at the data input terminal is 5.01×10−12A. FIG. 8 is a schematic diagram of the leakage current of the input terminal of the data signal DATA of the pixel circuit provided by the embodiments of the present disclosure. As illustrated in FIG. 8, the value of the leakage current of the data input terminal remains unchanged and is still 5.01×10−12A.

It can be obtained from the above analysis that the circuit structure using the combination of the MOS dual-gate structure and the CMOS structure can solve the problem of leakage of the storage capacitor Cst, and can further take into account the voltage range of the data signal DATA.

It should be noted that in the above specific embodiments, T6 is a P-type transistor, and the other transistors are all N-type transistors; but those skilled in the art may easily obtain a pixel circuit of T6 as an N-type transistor and the other transistors as P-type transistors based on the pixel circuit provided by the present disclosure. In an exemplary embodiment of the present disclosure, T6 is an N-type transistor, and the other transistors are P-type transistors. In this case, the first power signal VDD is a low-level signal, the cathode of the OLED is connected to the second node, and the anode of the OLED is connected to a high-level signal. The use of P-type thin film transistors may have the following advantages: for example, strong noise suppression capability; low-level turning-on and easy implementation of low levels in the charging management; P-type thin film transistors with simple manufacturing process and relatively low prices; P-type thin film transistors having better stability; or the like. Certainly, the pixel circuit provided by the present disclosure may also be changed to a CMOS circuit or the like, and may not be limited to the pixel circuit provided in the embodiments, and details are not described herein again.

Figure 9:
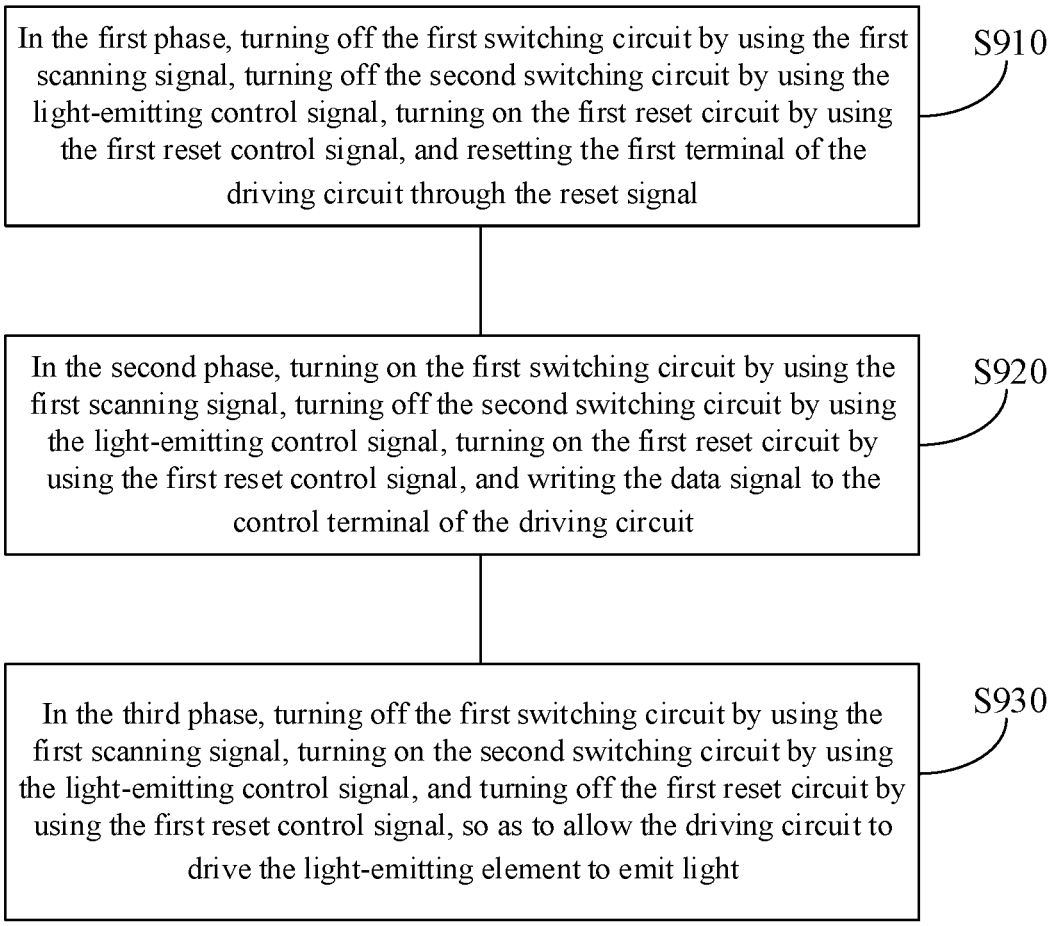
FIG. 9 is a flowchart of a driving method of a pixel circuit provided by at least one embodiment of the present disclosure.

Exemplary embodiments of the present disclosure further provide a driving method of a pixel circuit, which may be applied to the pixel circuit as illustrated in FIG. 1. As illustrated in FIG. 9, the driving method 900 of the pixel circuit includes the following steps.

Step S910, in the first phase, turning off the first switching circuit by using the first scanning signal, turning off the second switching circuit by using the light-emitting control signal, turning on the first reset circuit by using the first reset control signal, and resetting the first terminal of the driving circuit through the reset signal.

Step S920, in the second phase, turning on the first switching circuit by using the first scanning signal, turning off the second switching circuit by using the light-emitting control signal, turning on the first reset circuit by using the first reset control signal, and writing the data signal to the control terminal of the driving circuit.

Step S930, in the third phase, turning off the first switching circuit by using the first scanning signal, turning on the second switching circuit by using the light-emitting control signal, and turning off the first reset circuit by using the first reset control signal, so as to allow the driving circuit to drive the light-emitting element to emit light.

In the driving method of the pixel circuit provided by the embodiments of the present disclosure, the first reset circuit 400 is turned on in response to the reset signal GND to initialize the first terminal of the driving circuit 100, thereby prevent the first terminal (for example, the first electrode of the driving transistor DT) of the driving circuit 100 from being in the floating state during the reset phase and the data writing phase, and meanwhile, further avoiding the level of the control terminal of the driving circuit 100 (for example, the gate electrode of the driving transistor DT) from fluctuating due to the influence of parasitic capacitance during the light-emitting phase, so that the problem of uneven display of the display device is alleviated, and the display quality is improved.

For example, in at least one embodiment of the present disclosure, in the case where the pixel circuit further includes a third switching circuit, for example, the pixel circuit 20 illustrated in FIG. 2 and FIG. 3, Step S910 in the method 900 further includes: in the first phase, turning off the third switching circuit by using the first scanning signal and the second scanning signal. For example, Step S920 further includes: in the second phase, turning on the third switching circuit by using the first scanning signal and the second scanning signal. Step S930 further includes: in the third phase, turning off the third switching circuit 700 by using the first scanning signal and the second scanning signal.

For example, in some examples, in the case where the first switching circuit 200 includes the first transistor T1, the second switching circuit 300 includes the second transistor T2, the first reset circuit 400 includes the third transistor T3, the second reset circuit 800 includes the fourth transistor T4, the third switching circuit 700 includes the CMOS circuit (for example, reference may be made to the specific structure of the CMOS circuit in the above embodiments, but the structure of the CMOS circuit is not limited to this), and the transistors are all N-type transistors:

in Step S910, the first scanning signal Sn is at a low level, the second scanning signal Sm is at a high level, the reset control signal DIS is at a high level, and the light-emitting control signal EM is at a low level, the first scanning signal Sn, the second scanning signal Sm, the reset control signal DIS, and the light-emitting control signal EM turn on the third transistor T3 and the fourth transistor T4, turn off the first transistor T1, the CMOS circuit, and the second transistor T2, and the first electrode of the driving transistor DT and the first terminal of the light-emitting element 600 are reset through the reset signal GND;

in Step S920, the first scanning signal Sn is at a high level, the second scanning signal Sm is at a low level, the reset control signal DIS is at a high level, and the light-emitting control signal EM is at a low level, the first scanning signal Sn, the reset control signal DIS, and the light-emitting control signal EM turn on the first transistor T1, the CMOS circuit, the third transistor T3, and the fourth transistor T4, and turn off the second transistor T2, and the data signal DATA is written into the storage circuit 500;

in Step S930, the first scanning signal Sn is at a low level, the second scanning signal Sm is at a high level, the reset control signal DIS is at a low level, the light-emitting control signal EM is at a high level, the first scanning signal Sn, the second scanning signal Sm, the reset control signal DIS, and the light-emitting control signal EM turn off the first transistor T1, the CMOS circuit, the third transistor T3, and the fourth transistor T4, and turn on the second transistor T2, so as to enable the first power signal VDD to drive the light-emitting element 600 to emit light.

The third switching circuit 700 is controlled by the first scanning signal Sn and the second scanning signal Sm, which may reduce the leakage of the storage circuit 500 of the pixel circuit, solve the problem of crosstalk of the display device due to level loss of the storage circuit 500 caused by the leakage, and improve the display quality. Further, the loss of the data voltage is reduced, and the range of the data voltage is improved, which may facilitate implementing fine gray level display.

It should be noted that although various steps of the method in the present disclosure are described in a specific order in the drawings, this does not require or imply that these steps must be performed in the specific order, or that all the steps must be performed to achieve the desired result. Additionally or alternatively, some steps may be omitted, multiple steps may be combined into one step for execution, and/or one step may be divided into multiple steps for execution, etc.

Based on the description of the above embodiments, those skilled in the art may easily understand that the exemplary embodiments described here may be implemented by software, or may be implemented by combining software with necessary hardware. Therefore, the technical solution according to the embodiments of the present disclosure may be provided in the form of a software product, which may be stored in a non-volatile storage medium (which may be a CD-ROM, a U disk, a mobile hard disk, etc.) or in the network, and may include several instructions to cause a computing device (which may be a personal computer, a server, a mobile terminal, a network device, or the like) to execute the method according to the embodiments of the present disclosure.

In addition, the above-mentioned drawings are merely schematic illustrations of the processing included in the method according to the exemplary embodiments of the present disclosure, and are not intended for limitation. It can be readily understood that the processes shown in the above drawings do not indicate or limit the time sequence of these processes. In addition, it can be readily understood that these processes may be executed synchronously or asynchronously in multiple modules.

Figure 10:
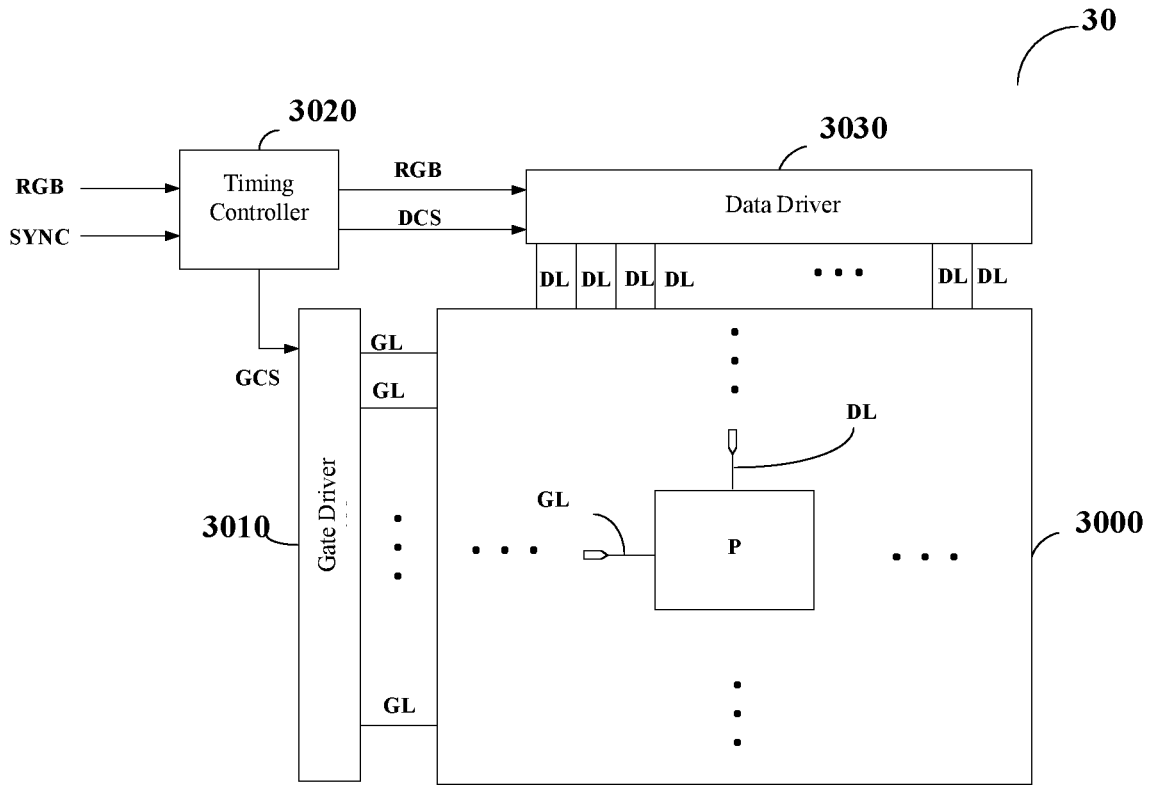
FIG. 10 is a schematic diagram of a display device provided by at least one embodiment of the present disclosure.

FIG. 10 is a schematic block diagram of a display device provided by some embodiments of the present disclosure. As illustrated in FIG. 10, the display device 30 may be applied to any product or component with a display function, such as various displays, mobile phones, tablet computers, notebook computers, digital photo frames, navigators, etc. For example, the display device 30 may be an OLED display device, a quantum dot light-emitting diode (QLED) display device, or the like.

For example, in an example, the display device 30 includes a gate driver 3010, a timing controller 3020, a data driver 3030, and a display panel 3000. The display panel 3000 includes a plurality of pixel units P defined according to intersection of a plurality of gate lines GL and a plurality of data lines DL. The gate driver 3010 is used to drive the plurality of gate lines GL. The data driver 3030 is used to drive the plurality of data lines DL. The timing controller 3020 is used to process the image data RGB input from the outside of the display device 30, provide the processed image data RGB to the data driver 3030, and output the scanning control signal GCS and the data control signal DCS to the gate driver 3010 and the data driver 3030, so as to control the gate driver 3010 and the data driver 3030.

For example, the display device 30 is a display device provided by any one of the embodiments of the present disclosure, or the display panel 3000 is a display panel provided by any one of the embodiments of the present disclosure. For example, the display device 30 or the display panel 3000 includes the pixel circuit 10 or 20 provided in any one of the above embodiments. For example, the pixel circuit 10 or 20 is provided in the pixel unit P of the pixel array region of the array substrate of the display panel 3000. For example, the first reset circuit 400 in the pixel circuit 10 illustrated in FIG. 1 is provided outside the pixel array region. For another example, the first reset circuit 400 and the second reset circuit 800 in the pixel circuit 20 illustrated in FIG. 2 are provided outside the pixel array region.

For example, the plurality of gate lines GL are correspondingly connected to the pixel units P arranged in a plurality of rows. For example, the gate driver 3010 may be implemented as a semiconductor chip, or integrated in the display panel 3000 to form a GOA circuit.

For example, the data driver 3030 uses the reference gamma voltage to convert digital image data RGB input from the timing controller 3020 into data signals according to a plurality of data control signals DCS from the timing controller 3020. The data driver 3030 provides the converted data signals to the plurality of data lines DL. For example, the data driver 3030 may be implemented as a semiconductor chip.

For example, the timing controller 3020 processes image data RGB which is externally input to match the size and the resolution of the display panel 3000, and then provides the processed image data to the data driver 3030. The timing controller 3020 uses synchronization signals (such as a dot clock DCLK, a data enable signal DE, a horizontal synchronization signal Hsync, and a vertical synchronization signal Vsync) input from the outside of the display device 30 to generate the plurality of scanning control signals GCS and the plurality of data control signals DCS. The timing controller 3020 provides the generated scanning control signals GCS and data control signals DCS to the gate driver 3010 and the data driver 3030, respectively, so as to control the gate driver 3010 and the data driver 3030.

The display device 30 may also include other components, such as a signal decoding circuit, a voltage converting circuit, etc. These components may, for example, adopt existing conventional components, and details are not described herein.

The display device 30 provided by at least one embodiment of the present disclosure may reduce the influence of the parasitic capacitance on the level of the gate electrode of the driving transistor during the light-emitting phase, thereby overcoming the problem of uneven display of the display device to a certain extent. Further, the leakage of the storage circuit in the pixel circuit at the control terminal of the first switching circuit may be reduced, and the problem of crosstalk of the display device due to level loss of the storage circuit caused by the leakage may be solved, thereby improving the display quality. Furthermore, the loss of the data voltage is reduced, and the range of the data voltage is improved, thereby facilitating the implementation of fine gray level display.

Figure 11:
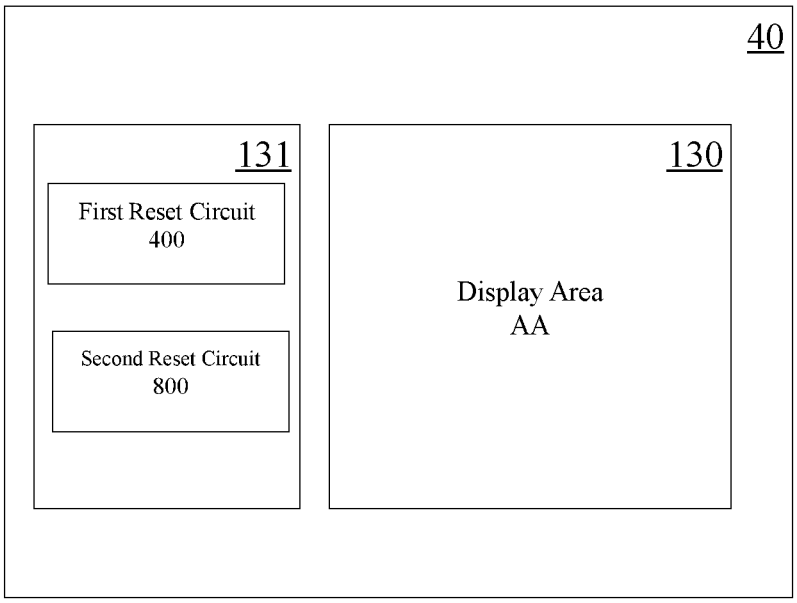
FIG. 11 is a schematic diagram of another display device provided by at least one embodiment of the present disclosure.

For example, in at least one embodiment of the present disclosure, as illustrated in FIG. 11, the display device 40 includes an array substrate 41, and the array substrate 41 includes a pixel region (for example, a display region AA) 130 and a non-pixel region 131. For example, the previous pixel circuit is provided on the array substrate 41, and the first reset circuit 400 in the pixel circuit is provided in the non-pixel region 130. For example, in some examples, in the case where the pixel circuit further includes the second reset circuit 800, the second reset circuit 800 is also provided in the non-pixel region 130.

For example, in some examples, as illustrated in FIG. 3, the first reset circuit 400 includes the third transistor T3, the second reset circuit 800 includes the fourth transistor T4, and the third transistor T3 and the fourth transistor T4 are provided in the non-pixel region 131, that is, outside the pixel region (for example, the display region AA) 130, so that the effective area of the pixel region 130 on the array substrate 41 is saved, and the number of pixel units per unit area may be increased, thereby facilitating high PPI design.

It should be noted that, in the embodiments of the present disclosure, the display device 40 may be, for example, any product or component with a display function, such as an OLED TV, a display, a mobile phone, a tablet computer, a notebook computer, a digital photo frame, a navigator, etc. The embodiments of the present disclosure are not limited in this aspect. For the technical effects of the display device 40, reference may be made to the above descriptions of the pixel circuit 10/20, and details are not described herein again.

The following statements should be noted:

(1) The accompanying drawings involve only the structure(s) in connection with the embodiment(s) of the present disclosure, and other structure(s) can adopt common design(s).

(2) In case of no conflict, the embodiments of the present disclosure and the features in the embodiments may be combined with each other to obtain a new embodiment.

Those skilled in the art will easily think of other embodiments of the present disclosure after considering the description and practicing the invention disclosed herein. The present application is intended to cover any variation, use or adaptive change of the present disclosure, which follows the general principle of the present disclosure and includes common knowledge or conventional technical means in the art not disclosed in the present disclosure. The description and embodiments are only regarded as illustrative. The true scope and spirit of the present disclosure are indicated by the claims.

It should be understood that the present disclosure is not limited to the particular structure described above and shown in the drawings, and various modifications and changes may be made without departing from the scope of the present disclosure. The scope of the present disclosure is merely limited by the attached claims.

What is claimed is:

1. A pixel circuit, comprising:

a driving circuit, comprising a first terminal, a second terminal, and a control terminal, and configured to drive a light-emitting element connected to the second terminal of the driving circuit to emit light; a first switching circuit, configured to be turned on in response to a first scanning signal to transmit a data signal to the control terminal of the driving circuit; a second switching circuit, connected to the first terminal of the driving circuit and configured to be turned on in response to a light-emitting control signal to transmit a first power signal to the first terminal of the driving circuit; a first reset circuit, connected to the first terminal of the driving circuit and configured to be turned on in response to a first reset control signal to transmit a reset signal to the first terminal of the driving circuit, and a second reset circuit, connected to a first terminal of the light-emitting element and configured to be turned on in response to a second reset control signal to transmit the reset signal to the first terminal of the light-emitting element, wherein the reset signal is used to reset simultaneously the first terminal of the driving circuit and the first terminal of the light-emitting element.

2. The pixel circuit according to claim 1, further comprising a third switching circuit, wherein the third switching circuit comprises a complementary metal oxide semiconductor circuit;

the third switching circuit comprises a first terminal, a second terminal, a first control terminal, and a second control terminal;

the first terminal of the third switching circuit is connected to the first switching circuit, and the second terminal of the third switching circuit is connected to the control terminal of the driving circuit;

the first control terminal is connected to a first scanning signal input terminal to receive the first scanning signal, and the third switching circuit is configured to be turned on in response to the first scanning signal to transmit the data signal from the first switching circuit to the control terminal of the driving circuit; and the second control terminal is connected to a second scanning signal input terminal to receive a second scanning signal, and the third switching circuit is further configured to be turned on in response to the second scanning signal to transmit the data signal from the first switching circuit to the control terminal of the driving circuit.

3. The pixel circuit according to claim 2, wherein the first scanning signal and the second scanning signal are synchronized, and a trigger level of the first scanning signal is opposite to a trigger level of the second scanning signal.

4. The pixel circuit according to claim 1, wherein the first reset control signal and the second reset control signal are a same reset control signal.

5. The pixel circuit according to claim 2, wherein the driving circuit comprises a driving transistor, a first electrode of the driving transistor serves as the first terminal of the driving circuit, a gate electrode of the driving transistor serves as the control terminal of the driving circuit, and a second electrode of the driving transistor serves as the second terminal of the driving circuit.

6. The pixel circuit according to claim 2, wherein the first switching circuit comprises a first transistor, a first electrode of the first transistor is connected to a data signal input terminal to receive the data signal, a second electrode of the first transistor is connected to the first terminal of the third switching circuit, and a gate electrode of the first transistor is connected to a first scanning signal input terminal to receive the first scanning signal.

7. The pixel circuit according to claim 1, wherein the second switching circuit comprises a second transistor, a first electrode of the second transistor is connected to a first power signal input terminal to receive the first power signal, a second electrode of the second transistor is connected to the first terminal of the driving circuit, and a gate electrode of the second transistor is connected to a light-emitting control signal input terminal to receive the light-emitting control signal.

8. The pixel circuit according to claim 1, wherein the first reset circuit comprises a third transistor, a first electrode of the third transistor is connected to a reset signal input terminal to receive the reset signal, a second electrode of the third transistor is connected to the first terminal of the driving circuit, and a gate electrode of the third transistor is connected to a first reset control signal input terminal to receive the first reset control signal.

9. The pixel circuit according to claim 2, wherein the third switching circuit comprises a fifth transistor and a sixth transistor;

a first electrode of the fifth transistor is connected to the first switching circuit, a second electrode of the fifth transistor is connected to the control terminal of the driving circuit, and a gate electrode of the fifth transistor is connected to a first scanning signal input terminal to receive the first scanning signal; and a first electrode of the sixth transistor is connected to the first switching circuit, a second electrode of the sixth transistor is connected to the control terminal of the driving circuit, and a gate electrode of the sixth transistor is connected to a second scanning signal input terminal to receive the second scanning signal.

10. The pixel circuit according to claim 9, wherein the fifth transistor is an N-type transistor and the sixth transistor is a P-type transistor, or the fifth transistor is a P-type transistor and the sixth transistor is an N-type transistor.

11. The pixel circuit according to claim 1, wherein the second reset circuit comprises a fourth transistor, a first electrode of the fourth transistor is connected to a reset signal input terminal to receive the reset signal, a second electrode of the fourth transistor is connected to the first terminal of the light-emitting element, and a gate electrode of the fourth transistor is connected to a second reset control signal input terminal to receive the second reset control signal.

12. The pixel circuit according to claim 1, further comprising a storage circuit, wherein the storage circuit is connected to the control terminal of the driving circuit, and is configured for storing the data signal.

13. The pixel circuit according to claim 12, wherein the storage circuit comprises a storage capacitor, a first electrode of the storage capacitor is connected to the control terminal of the driving circuit, and a second electrode of the storage capacitor is connected to a second power signal input terminal to receive a second power signal.

14. A display panel, comprising the pixel circuit according to claim 1.

15. A display device, comprising the pixel circuit according to claim 1.

16. The display device according to claim 15, further comprising an array substrate, wherein the pixel circuit is on the array substrate, the array substrate comprises a pixel region and a non-pixel region, and the first reset circuit and the second reset circuit are in the non-pixel region.

17. A pixel circuit, comprising:

a first transistor, a second transistor, a third transistor, a fourth transistor, a fifth transistor, a sixth transistor, a driving transistor, and a storage capacitor, wherein a first electrode of the first transistor is connected to a data signal input terminal to receive a data signal, a second electrode of the first transistor is connected to a first electrode of the fifth transistor, and a gate electrode of the first transistor is connected to a first scanning signal input terminal to receive a first scanning signal; a first electrode of the second transistor is connected to a first power signal input terminal to receive a first power signal, a second electrode of the second transistor is connected to a first electrode of the driving transistor, and a gate electrode of the second transistor is connected to a light-emitting control signal input terminal to receive a light-emitting control signal; a first electrode of the third transistor is connected to a reset signal input terminal to receive a reset signal, a second electrode of the third transistor is connected to the first electrode of the driving transistor, and a gate electrode of the third transistor is connected to a first reset control signal input terminal to receive a first reset control signal; a first electrode of the fourth transistor is connected to the reset signal input terminal to receive the reset signal, a second electrode of the fourth transistor is connected to a second electrode of the driving transistor, and a gate electrode of the fourth transistor is connected to a second reset control signal input terminal to receive a second reset control signal; a second electrode of the fifth transistor is connected to a gate electrode of the driving transistor, and a gate electrode of the fifth transistor is connected to the first scanning signal input terminal to receive the first scanning signal; a first electrode of the sixth transistor is connected to the second electrode of the first transistor, a second electrode of the sixth transistor is connected to the gate electrode of the driving transistor, and a gate electrode of the sixth transistor is connected to a second scanning signal input terminal to receive a second scanning signal; and a first electrode of the storage capacitor is connected to the gate electrode of the driving transistor; and a second electrode of the storage capacitor is connected to a second power signal input terminal to receive a second power signal; wherein the reset signal is used to reset the first terminal of the driving circuit and the first terminal of the light-emitting element.

18. A driving method of a pixel circuit, used for driving a pixel circuit, the pixel circuit comprising:

a driving circuit, comprising a first terminal, a second terminal, and a control terminal, and configured to drive a light-emitting element connected to the second terminal of the driving circuit to emit light;

a first switching circuit, configured to be turned on in response to a first scanning signal to transmit a data signal to the control terminal of the driving circuit;

a second switching circuit, connected to the first terminal of the driving circuit and configured to be turned on in response to a light-emitting control signal to transmit a first power signal to the first terminal of the driving circuit;

a first reset circuit, connected to the first terminal of the driving circuit and configured to be turned on in response to a first reset control signal to transmit a reset signal to the first terminal of the driving circuit; and a second reset circuit, connected to a first terminal of the light-emitting element and configured to be turned on in response to a second reset control signal to transmit the reset signal to the first terminal of the light-emitting element;

wherein the reset signal is used to reset the first terminal of the driving circuit and the first terminal of the light-emitting element;

wherein the driving method comprises:

in a first phase, turning off the first switching circuit by using the first scanning signal, turning off the second switching circuit by using the light-emitting control signal, turning on the first reset circuit by using the first reset control signal and resetting the first terminal of the driving circuit through the reset signal, and turning on the second reset circuit by using the second reset control signal and resetting the first terminal of the light-emitting element through the reset signal;

in a second phase, turning on the first switching circuit by using the first scanning signal, turning off the second switching circuit by using the light-emitting control signal, turning on the first reset circuit by using the first reset control signal, turning on the second reset circuit by using the second reset control signal, and writing the data signal to the control terminal of the driving circuit; and in a third phase, turning off the first switching circuit by using the first scanning signal, turning on the second switching circuit by using the light-emitting control signal, turning off the first reset circuit by using the first reset control signal, and turning off the second reset circuit by using the second reset control signal, so as to allow the driving circuit to drive the light-emitting element to emit light.

19. The driving method of the pixel circuit according to claim 18, wherein in a case where the pixel circuit further comprises a third switching circuit, the driving method further comprises:

in the first phase, turning off the third switching circuit by using the first scanning signal and the second scanning signal;

in the second phase, turning on the third switching circuit by using the first scanning signal and the second scanning signal; and in the third phase, turning off the third switching circuit by using the first scanning signal and the second scanning signal.

* * * * *